US007860414B2

(12) United States Patent
Itoh et al.

(10) Patent No.: US 7,860,414 B2
(45) Date of Patent: Dec. 28, 2010

(54) HEATING APPARATUS AND FIXING APPARATUS

(75) Inventors: Kazuyoshi Itoh, Nakai-machi (JP); Yasuhiro Uehara, Nakai-machi (JP)

(73) Assignee: Fuji Xerox Co., Ltd., Tokyo (JP)

( * ) Notice: Subject to any disclaimer, the term of this patent is extended or adjusted under 35 U.S.C. 154(b) by 294 days.

(21) Appl. No.: 11/391,338

(22) Filed: Mar. 29, 2006

(65) Prior Publication Data

US 2007/0047983 A1 Mar. 1, 2007

(30) Foreign Application Priority Data

Aug. 29, 2005 (JP) ..... 2005-247788

(51) Int. Cl.
*G03G 15/20* (2006.01)

(52) U.S. Cl. ..... 399/33; 399/67; 399/69; 399/328

(58) Field of Classification Search ..... 399/33, 399/67, 69, 328
See application file for complete search history.

(56) References Cited

U.S. PATENT DOCUMENTS

| | | | | |
|---|---|---|---|---|
| 5,386,276 | A * | 1/1995 | Swales et al. | 399/8 |
| 5,801,359 | A * | 9/1998 | Mano et al. | 219/667 |
| 5,819,150 | A * | 10/1998 | Hayasaki et al. | 399/330 |
| 6,246,843 | B1 * | 6/2001 | Nanataki et al. | 399/45 |
| 6,346,800 | B1 * | 2/2002 | Mano et al. | 323/282 |
| 6,359,269 | B1 * | 3/2002 | Hayasaki et al. | 219/665 |
| 6,373,232 | B1 * | 4/2002 | Mano et al. | 323/282 |
| 7,005,619 | B2 * | 2/2006 | Fujii et al. | 219/619 |
| 2003/0155349 | A1 * | 8/2003 | Matsuo et al. | 219/664 |
| 2006/0159477 | A1 * | 7/2006 | Tomita et al. | 399/67 |

FOREIGN PATENT DOCUMENTS

| | | |
|---|---|---|
| JP | 1-0 23764 | 1/1989 |
| JP | A-10-254263 | 9/1998 |
| JP | 11-191483 | 7/1999 |
| JP | A-11-352804 | 12/1999 |
| JP | 2001-331060 | 11/2001 |
| JP | A-2002-148983 | 5/2002 |
| JP | 2002-208469 | 7/2002 |
| JP | 2005243483 A * | 9/2005 |

* cited by examiner

*Primary Examiner*—David M Gray
*Assistant Examiner*—Geoffrey T Evans
(74) *Attorney, Agent, or Firm*—Morgan, Lewis & Biockius LLP

(57) ABSTRACT

A heating apparatus includes: an exciting coil provided in close vicinity of a heated body having a conductive layer; a capacitor connected serially or in parallel with the exciting coil; a switching element that generates a high frequency current by turning on/off a direct current and that supplies the high frequency current to the exciting coil and the capacitor; a specifying unit that specifies an electric value to be supplied to the exciting coil; an output unit that outputs, to the switching element, a driving signal to turn on the switching element for a period determined in correspondence with the specified electric value; a voltage detection unit that detects a flyback voltage value generated in a resonance circuit including the exciting coil and the capacitor; and an abnormality detection unit that detects an abnormality in the heated body based on the detected flyback voltage value.

8 Claims, 9 Drawing Sheets

HEATING APPARATUS AND FIXING APPARATUS

This application claims the benefit of Japanese Patent Application No. 2005-247788 filed in Japan on Aug. 29, 2005, which is hereby incorporated by reference.

BACKGROUND

1. Technical Field

The present invention relates to a heating apparatus using electromagnetic induction and a fixing apparatus for fixing a toner image onto a recording material using the heating apparatus.

2. Related Art

Generally, in an image forming apparatus using powder toner, in a process to fix a toner image, a method of electrostatically transferring a toner image onto a recording medium, then placing the recording medium between a heating member and a pressure member, and heat-melting the toner image thus press-fixing the toner image to the recording medium, is widely employed. For the heating of the heating member, an arrangement where the heating member has a conductive layer so as to generate heat by the conductive layer by electromagnetic induction heating has been proposed. The electromagnetic induction heating provides an exciting coil to generate a varying magnetic field near the conductive layer (heating member) and causing the conductive layer to generate heat by an eddy current generated in the conductive layer. According to the electromagnetic induction heating, as the heating member is directly heated and the range of high temperature by heating is extremely limited, the heating member can be heated to a predetermined temperature in a short time. Accordingly, in comparison with heating using a halogen lamp or the like as a heating source, warm-up time of the fixing apparatus can be reduced, and electric consumption can be reduced.

On the other hand, as the heating member (fixing member), as well as a heating roller, an endless fixing belt is generally used. The endless fixing belt is a belt put around plural support rollers, or is a belt with an inside pressure member and is circulate-driven without a roller. The fixing belt has a thin heat-resisting resin layer or the like as a base layer. As the thermal capacity of the fixing belt is smaller than that of the heating roller, the warm-up time is shorter in comparison with that of the apparatus using the heating roller. Further, in the non-expanded type fixing belt, the area to be contact with another member can be reduced, thereby heat transfer to the other member can be reduced. Accordingly, further efficient warming up can be performed.

In a fixing apparatus where an endless belt as a heating member is heated by electromagnetic induction, when the endless belt is put around plural rollers, the exciting coil is provided to face the inner surface or outer surface of the belt. On the other hand, when the endless belt is circulate-driven without a roller, the exciting coil is provided in a position close and opposite to the outer peripheral surface of the endless belt. Then, a varying magnetic field is generated in a direction through the endless belt, and an eddy current is induced around the magnetic field.

Generally, a high frequency current supplied to the exciting coil is generated by switching a direct current at a high frequency, and constant current control or constant energy control is performed. Further, upon electric power supply to the exciting coil, the temperature of the fixing member as a heated body is detected with a temperature sensor and the amount of supplied electric power is controlled and/or power supply ON/OFF control is performed so as to maintain a predetermined temperature.

The heating apparatus using the electromagnetic induction and the fixing apparatus using the heating apparatus have advantages as described above while they also have disadvantages. One of the problems is that as the speed of temperature rising is fast, a safety measure against abnormal high temperature (overheated) state of the heated body (e.g., the heating member) cannot be taken without difficulty. As the safety measure against abnormal high temperature, in the case of the fixing apparatus using the conventional halogen lamp, a thermostat, a temperature fuse or the like is provided in contact with or in the vicinity of a fixing roller, such that when the temperature of the fixing roller becomes a predetermined temperature, a current path to the halogen lamp is blocked and overheating of the fixing roller is prevented.

However, the thermostat or the temperature fuse operate with a certain degree of time delay. That is, the detection of the actual temperature of the heated body is delayed, and when the thermostat or the like detects a predetermined reference temperature and operates, the temperature of the heated body is higher than the reference temperature. In the case of the halogen lamp where the speed of temperature rising is slow, the above overheating of the fixing roller can be sufficiently prevented. In the case of the electromagnetic induction heating, however, as the speed of temperature rising is fast, the heating cannot be appropriately controlled. Especially when a belt having a small thermal capacity is used as the heated body, the above problem is particularly significant.

FIG. 9 is a graph schematically showing an example of the difference among the temperature of the heated body, that of a bimetal and that of a fuse to detect the temperature of the heated body.

In the case of the thermostat where the bimetal is directly in contact with the heated body, it takes about 50 to 60 seconds (t0 to t1) to detect abnormal high temperature T0 of the heated body. Further, in the case of the temperature fuse, as the temperature fuse cannot be brought into direct contact with the fixing roller, it takes about 100 seconds (t0 to t2) to detect the abnormal high temperature while the temperature of the fixing roller increases from the abnormal temperature T0 to temperature T1 or T2. In a case where a rotating body such as a belt having a small thermal capacity is used, the inclination of temperature rising is steeper, the temperature further increased (T1, T2) during the delay of thermal transmission is higher. Accordingly, it is necessary to use a high heat-resistant member to resist such high temperature. On the other hand, when the reference temperature for control is set to a temperature (T3 or T4) lower than the abnormal temperature T0 of the heated body, the error of temperature detection is increased. The tendency is significant as the inclination of temperature rising is steeper.

SUMMARY

According to an aspect of the present invention, a heating apparatus includes: an exciting coil provided in close vicinity of a heated body having a conductive layer; a capacitor connected serially or in parallel with the exciting coil; a switching element that generates a high frequency current by turning on/off a direct current and that supplies the high frequency current to the exciting coil and the capacitor; a specifying unit that specifies an electric value to be supplied to the exciting coil; an output unit that outputs, to the switching element, a driving signal to turn on the switching element for a period determined in correspondence with the specified electric value; a voltage detection unit that detects a flyback voltage value generated in a resonance circuit including the exciting coil and the capacitor; and an abnormality detection unit that detects an abnormality in the heated body based on the detected flyback voltage value.

BRIEF DESCRIPTION OF THE DRAWINGS

The above and other object, features and advantages of the present invention will become more apparent from the following detailed description when taken in conjunction with the accompanying drawings wherein.

DETAILED DESCRIPTION

Hereinbelow, an exemplary embodiment of the present invention will now be described in detail in accordance with the accompanying drawings.

Figure 1:
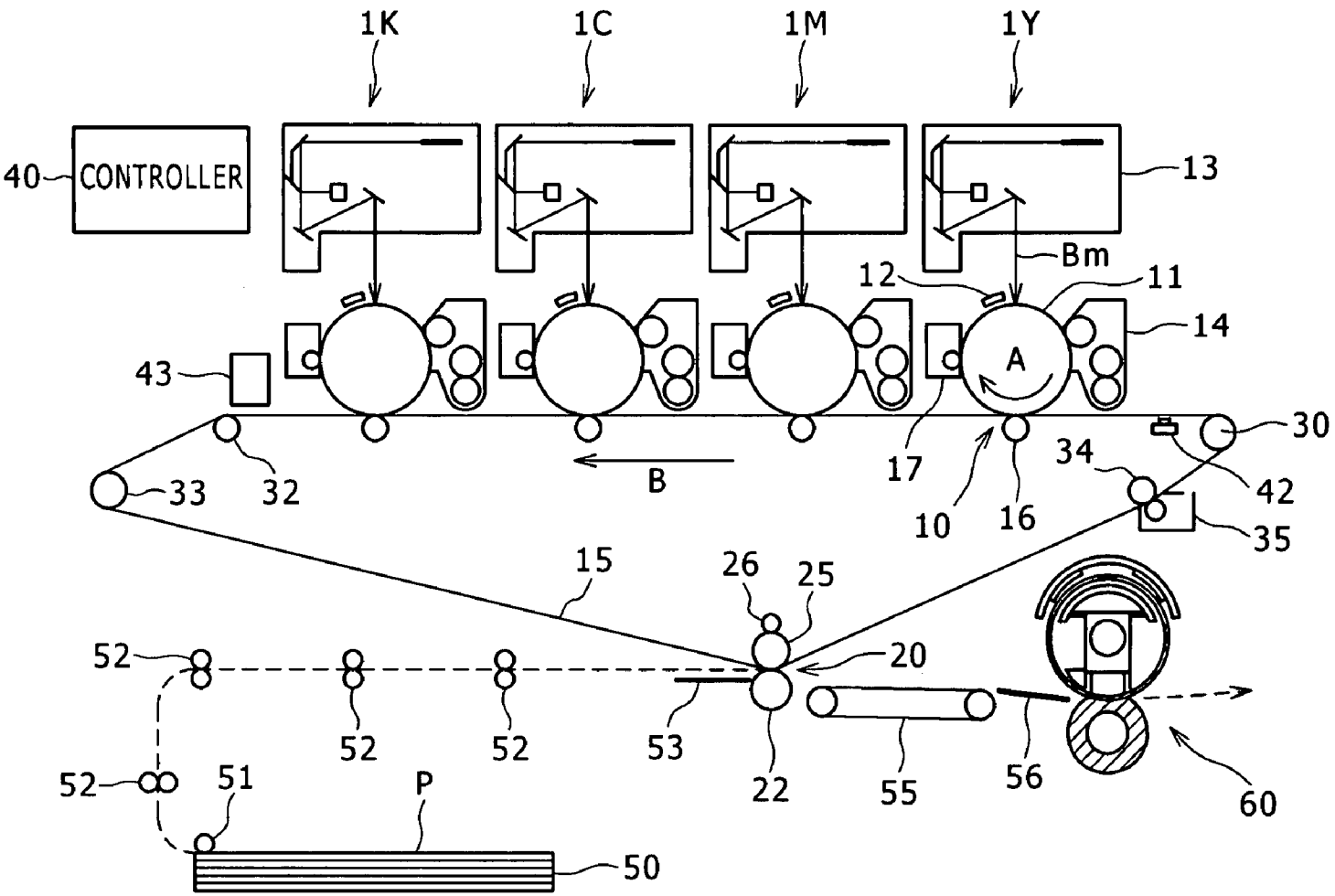
FIG. 1 is a schematic cross-sectional view showing the entire configuration of an image forming apparatus according to an exemplary embodiment of the present invention.

FIG. 1 is a schematic cross-sectional view showing the entire configuration of an image forming apparatus according to an exemplary embodiment of the present invention. The image forming apparatus in FIG. 1 is a tandem-type and intermediate-transfer type image forming apparatus. The image forming apparatus has plural image forming units 1Y, 1M, 1C and 1K, in which toner images of respective color components are formed by an electrophotographic method, and a first transfer part 10 to sequentially transfer (first-transfer) the color component toner images formed with the respective image forming units 1Y, 1M, 1C and 1K onto an intermediate transfer belt 15. Further, the image forming apparatus has a second transfer part 20 to collectively transfer (second-transfer) the overlaid toner images (unfixed toner image) transferred on the intermediate transfer belt 15 onto a sheet P as a recording material, and a fixing apparatus 60 to fix the second-transferred image to the sheet P. Further, the image forming apparatus has a controller 40 to control the operations of the plural devices (units).

In this exemplary embodiment, each of the image forming units 1Y, 1M, 1C and 1K has a photoreceptor drum 11 to rotate in an arrow A direction, a charger 12 to charge the photoreceptor drum 11 and a laser exposure unit 13 to write an electrostatic latent image on the photoreceptor drum 11 (in the figure, an exposure beam is denoted by "Bm"). Further, each of the image forming units 1Y, 1M, 1C and 1K has a developer 14, containing color component toner, to visualize the electrostatic latent image on the photoreceptor drum 11, a first transfer roller 16 to transfer the color component toner image formed on the photoreceptor drum 11 onto the intermediate transfer belt 15 in the first transfer part 10, and a drum cleaner 17 to remove residual toner on the photoreceptor drum 11. The image forming units 1Y, 1M, 1C and 1K are arranged in approximately straight line in the order of yellow (Y), magenta (M), cyan (C) and black (K) from the upstream side of the intermediate transfer belt 15.

The intermediate transfer belt 15 is a film type endless belt of resin such as polyimide or polyamide containing an appropriate amount of anti-static agent such as carbon black. The belt has a specific volume resistance of $10^6$ to $10^{14}$ Ωcm, and its thickness is e.g. about 0.1 mm. The intermediate transfer belt 15 is circulate-driven with various rollers at a predetermined speed in a direction B in FIG. 1. The various rollers include a drive roller 31, driven with a motor (not shown) to attain an excellent constant speed, to rotate the intermediate transfer belt 15, a support roller 32 to support the intermediate transfer belt 15 extended along the direction of the array of the photoreceptor drums 11 in approximately straight line, a tension roller 33 to apply a constant tensile force to the intermediate transfer belt 15 and to function as a correction roller to prevent walk of the intermediate transfer belt 15, a backup roller 25 provided in a second transfer part 20, and a cleaning backup roller 34 provided in a cleaning part to sweep residual toner on the intermediate transfer belt 15.

The first transfer part 10 has a first transfer roller 16 provided to face the photoreceptor drum 11 with the intermediate transfer belt 15 therebetween. The first transfer roller 16 has a shaft and a sponge layer as an elastic layer fixed around the shaft. The shaft is a columnar bar of metal such as iron or SUS. The sponge layer is a sponge cylindrical roller formed with blend rubber containing NBR, SBR and EPDM with a conductive agent such as carbon black, and its specific volume resistance is $10^{7.5}$ to $10^{8.5}$ Ωcm. The first transfer roller 16 is provided in press-contact with the photoreceptor drum 11 with the intermediate transfer belt 15 therebetween. Further, a voltage having an opposite polarity (first transfer bias) to toner charging polarity (hereinafter, minus polarity) is applied to the first transfer roller 16. In this arrangement, the toner images on the respective photoreceptor drums 11 are sequentially electrostatically drawn onto the intermediate transfer belt 15, and a toner image is formed with the overlaid toner images on the intermediate transfer belt 15.

The second transfer part 20 has a second transfer roller 22 provided on the toner image holding side of the intermediate transfer belt 15 and a backup roller 25. The backup roller 25 has a tube of carbon-diffused blend rubber containing EPDM and NBR as its surface and EPDM rubber inside. The backup roller 25 has a surface resistance of $10^7$ to $10^{10}$Ω/□, and its hardness is set to e.g. 70° (ASKER C). The backup roller 25 is provided on the rear surface side of the intermediate transfer belt 15 as an electrode facing the second transfer roller 22. A metal feeding roller 26, to which a second transfer bias is stably applied, is provided in contact with the backup roller 25.

On the other hand, the second transfer roller 22 has a shaft and a sponge layer as an elastic layer fixed around the shaft. The shaft is a columnar bar of metal such as iron or SUS. The sponge layer is a sponge cylindrical roller formed with blend rubber containing NBR, SBR and EPDM with a conductive agent such as carbon black, and its specific volume resistance is $10^{7.5}$ to $10^{8.5}$ Ωcm. The second transfer roller 22 is provided in press-contact with the backup roller 25 with the intermediate transfer belt 15 therebetween. Further, the second transfer roller 22 is grounded. The second transfer bias is generated between the second transfer roller 22 and the backup roller 25, and the toner image is second-transferred onto the sheet P conveyed to the second transfer part 20.

Further, on the downstream side of the intermediate transfer belt 15 in the second transfer part 20, an intermediate transfer belt cleaner 35 to remove residual toner and paper powder on the intermediate transfer belt 15 after second transfer and clean the surface of the intermediate transfer belt 15 is attachably/separably provided with respect to the intermediate transfer belt 15. On the other hand, on the upstream side of the yellow image forming unit 1Y, a reference sensor (home position sensor) 42 to generate a reference signal for matching of image forming timing in each of the image forming units 1Y, 1M, 1C and 1K is provided. Further, on the downstream side of the black image forming unit 1K, an image density sensor 43 for image quality control is provided. The reference sensor 42 recognizes a predetermined mark on the rear side of the intermediate transfer belt 15 and generates a reference signal. The image forming units 1Y, 1M, 1C and 1K start image formation in accordance with an instruction from the controller 40 based on the recognition of the reference signal.

Further, in the image forming apparatus according to this exemplary embodiment, as a paper conveyance system, a paper tray 50 to hold the sheet P, a pickup roller 51 to pick up the sheet P accumulated in the paper tray 50 at predetermined timing and convey the sheet, a conveyance roller 52 to convey the sheet P fed with the pickup roller 51, a conveyance chute 53 to send the sheet P conveyed with the conveyance roller 52 to the second transfer part 20, a conveyance belt 55 to convey the sheet P, after second transfer by the second transfer roller 22, to the fixing apparatus 60, and a fixing entrance guide 56 to guide the sheet P into the fixing apparatus 60.

Next, the basic image forming process in the image forming apparatus according to this exemplary embodiment will be described. In the image forming apparatus in FIG. 1, image data outputted from an image input terminal (IIT) (not shown), a personal computer (PC) (not shown) or the like is subjected to predetermined image processing by an image processing system (IPS) (not shown) then to image forming operation by the image forming units 1Y, 1M, 1C and 1K. In the IPS, shading correction, positional shift correction, brightness/color space conversion, gamma correction, various image editing such as frame deletion, color editing and moving editing are performed on the input reflectance data. The image data subjected to the image processing is converted to Y, M, C and K color material gray level data and outputted to the laser exposure unit 13.

In the laser exposure unit 13, the exposure beam Bm outputted from e.g. a semiconductor laser is emitted on the photoreceptor drums 11 of the respective image forming units 1Y, 1M, 1C and 1K in correspondence with the input color material gray level data. In the photoreceptor drums 11 of the respective image forming units 1Y, 1M, 1C and 1K, the surface is charged with the charger 12, then the surface is exposed with the laser exposure unit 13, and an electrostatic latent image is formed. The formed electrostatic latent images are developed as Y, M, C and K color toner images with the respective image forming units 1Y, 1M, 1C and 1K.

The toner images formed on the photoreceptor drums 11 of the image forming units 1Y, 1M, 1C and 1K are transferred onto the intermediate transfer belt 15 in the first transfer part 10 where the photoreceptor drums 11 are in contact with the intermediate transfer belt 15. More particularly, in the first transfer part 10, a voltage (first transfer bias) having an opposite polarity to toner charging polarity (minus polarity) is applied to the base material of the intermediate transfer belt 15 from the first transfer roller 16, and the toner images are sequentially overlaid on the surface of the intermediate transfer belt 15 thereby the first transfer is performed.

When the toner images have been sequentially transferred onto the surface of the intermediate transfer belt 15, the intermediate transfer belt 15 is moved, then the toner image is conveyed to the second transfer part 20. When the toner image has been conveyed to the second transfer part 20, in the paper conveyance system, the pickup roller 51 rotates at the timing of conveyance of the toner image to the second transfer part 20, and the sheet P in a predetermined size is fed from the paper tray 50. The sheet P fed by the pickup roller 51 is conveyed with the conveyance roller 52, then sent to the second transfer part 20 via the conveyance chute 53. Before the sheet P arrives at the second transfer part 20, the sheet P is temporarily stopped, then as a registration roller (not shown) rotates at the timing of movement of the intermediate transfer belt 15 holding the toner image, positioning is performed between the position of the sheet P and the position of the toner image.

In the second transfer part 20, the second transfer roller 22 is pressed into contact with the backup roller 25 via the intermediate transfer belt 15. At this time, the sheet P conveyed at synchronized timing is held between the intermediate transfer belt 15 and the second transfer roller 22. Then, a voltage (second transfer bias) having the same polarity as that of the toner charging polarity (minus polarity) is applied from the feeding roller 26, and a transfer electric field is formed between the second transfer roller 22 and the backup roller 25. Then, the unfixed toner image held on the intermediate transfer belt 15 is electrostatically transferred at once onto the sheet P in the second transfer part 20 where the sheet is pressed between the second transfer roller 22 and the backup roller 25.

Thereafter, the sheet P where the toner image has been electrostatically transferred is conveyed with the second transfer roller 22 in a state where it is separated from the intermediate transfer belt 15, to the conveyance belt 55 on the downstream side of the second transfer roller 22 in the paper conveyance direction. The conveyance belt 55 conveys the sheet P to the fixing apparatus 60 at an optimum conveyance speed for the fixing apparatus 60. The unfixed toner image on the sheet P conveyed to the fixing apparatus 60 is subjected to fixing processing using heat and pressure by the fixing apparatus 60, thereby fixed onto the sheet P. Then the sheet P where a fixed image has been formed is conveyed to a discharge paper tray provided at a discharge port of the image forming apparatus.

On the other hand, when the transfer to the sheet P has been completed, residual toner on the intermediate transfer belt 15 is conveyed to the cleaning part by the rotation of the intermediate transfer belt 15, and removed from the intermediate transfer belt 15 with the cleaning backup roller 34 and the intermediate transfer belt cleaner 35.

Next, the fixing apparatus 60 used in the image forming apparatus according to this exemplary embodiment will be described.

Figure 2:
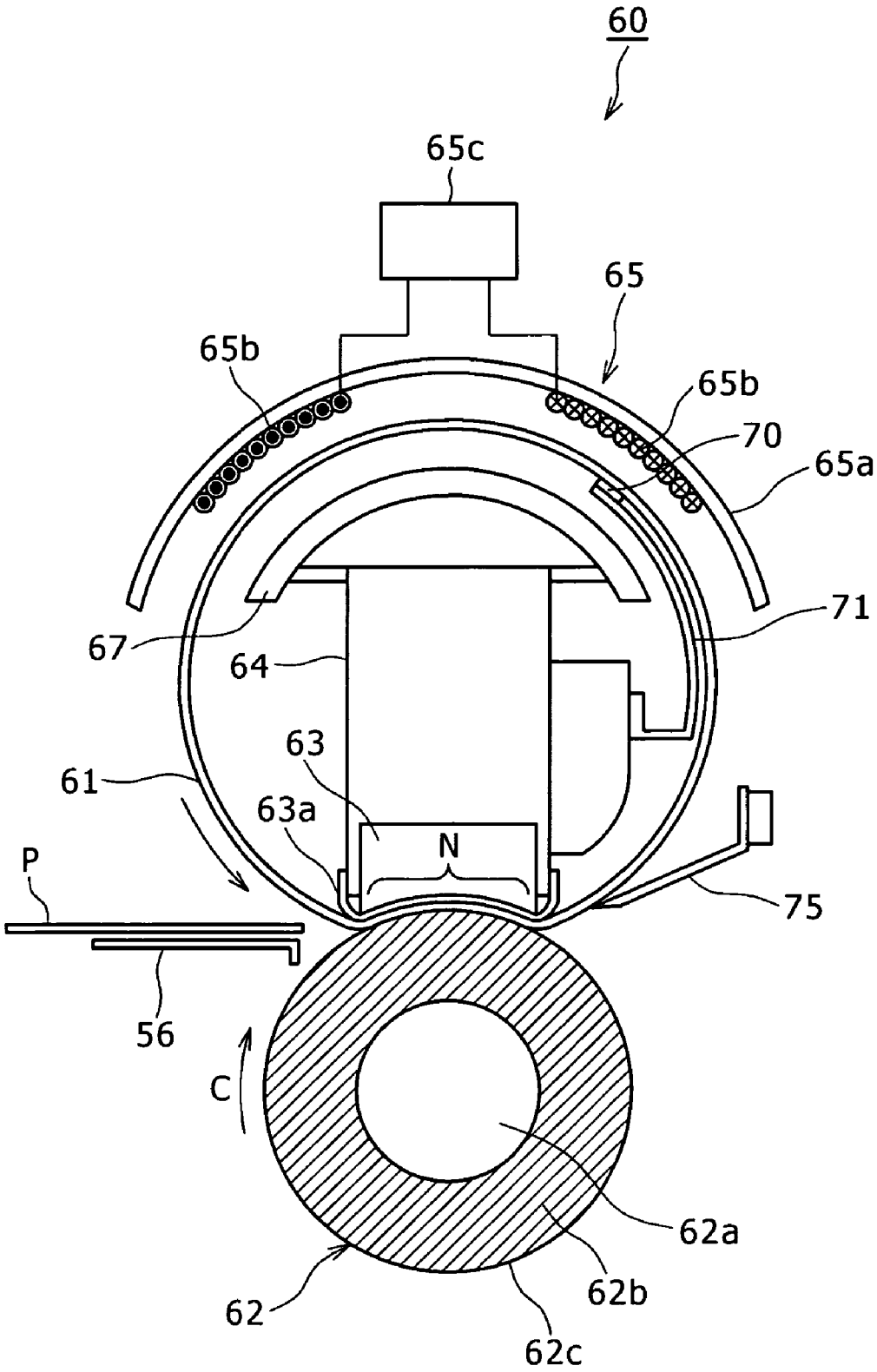
FIG. 2 is a cross-sectional view showing the configuration of a fixing apparatus provided in the image forming apparatus.

FIG. 2 is a cross-sectional view showing the configuration of the fixing apparatus 60 according to this exemplary embodiment. As shown in FIG. 2, the fixing apparatus 60 has, as principal parts, a fixing belt 61 as an example of a heating member (endless belt member) having an endless peripheral surface, a pressure roller 62 provided in press-contact with the outer peripheral surface of the fixing belt 61, to rotate the fixing belt 61, a pressing pad 63 provided in press-contact with the pressure roller 62 via the fixing belt 61 inside the fixing belt 61, a pad support member 64 to support the pressing pad 63 or the like, an electromagnetic induction heating member 65, formed along the outer peripheral shape of the fixing belt 61 and provided away from the fixing belt 61 with a predetermined gap, as an example of a heating unit to perform electromagnetic induction heating on the fixing belt 61 in its lengthwise direction, and a ferrite member 67 provided along the inner peripheral surface of the fixing belt 61 inside the fixing belt 61, to enhance the heating efficiency of heating of the fixing belt 61 by the electromagnetic induction heating unit 65.

Figure 3A:
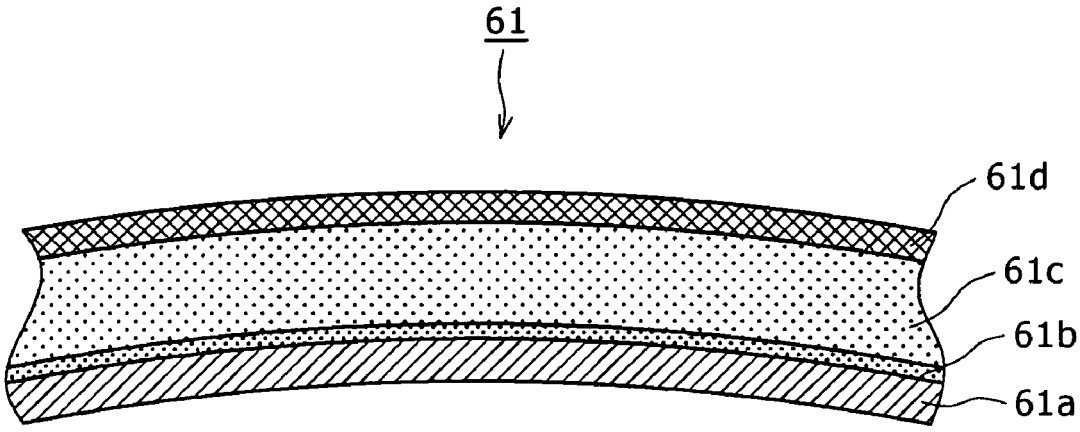
FIGS. 3A and 3B are enlarged cross-sectional views of a fixing belt used in the fixing apparatus.

As shown in FIG. 3A, the fixing belt 61 has a base layer 61*a* of a sheet member having high thermal resistance, a conductive layer 61*b*, an elastic layer 61*c*, and a surface release layer 61*d* as an outer peripheral surface, deposited from its inner peripheral surface side. Further, it may be arranged such that a primer layer or the like for adhesion is provided among these layers.

As the base layer 61*a*, a flexible material having high mechanical strength and thermal resistance such as fluorine resin, polyimide resin, polyamide resin, polyamide imide resin, PEEK resin, PES resin, PPS resin, PFA resin, PTFE resin or FEP resin is used. The thickness of the base layer 61*a* is 10 to 150 μm or may be 30 to 100 μm. When the thickness is less than 10 μm, the strength as the fixing belt 61 cannot be acquired. When the thickness is greater than 150 μm, the flexibility is lost, and further, the thermal capacity is increased and the temperature-rising time is prolonged. In this exemplary embodiment, a sheet member of polyimide resin having a thickness of 80 μm is employed.

The conductive layer 61*b* is a layer (heat generating layer) where induction heat generation is performed with a magnetic field induced by the electromagnetic induction heating unit 65. As the conductive layer 61*b*, a metal layer of iron, cobalt, nickel, copper, aluminum, chrome or the like having a thickness about 1 to 80 μm is employed. Further, the material and thickness of the conductive layer 61*b* are appropriately selected so as to realize a specific resistance value to acquire sufficient heat generation with an eddy current by the electromagnetic induction. In this exemplary embodiment, a cupper layer having a thickness of about 10 μm is employed.

The thickness of the elastic layer 61*c* is 10 to 500 μm or may be 50 to 300 μm. As the material of the elastic layer 61*c*, silicone rubber, fluorine rubber, fluorosilicone rubber or the like having excellent thermal resistance and thermal conductivity is employed. In this exemplary embodiment, silicone rubber having rubber hardness of 15° (JIS-A: JIS-K A type test machine) and thickness of 200 μm is employed.

Upon color image printing, especially printing of photographic image or the like, a solid image is often formed in a large area on the sheet P. Accordingly, when the surface of the fixing belt 61 (surface release layer 61*d*) cannot follow the irregularity of the sheet P or toner image, heating unevenness occurs in the toner image, and glossiness unevenness occurs in a fixed image in an area where a heat transfer amount is large while an area where the heat transfer amount is small. That is, the area where the heat transfer amount is large has high glossiness, while the area where the heat transfer amount is small has low glossiness. This phenomenon easily occurs when the thickness of the elastic layer 61*c* is less than 10 μm. Accordingly, the thickness of the elastic layer 61*c* may be set to be equal to or greater than 10 μm, or may be equal to or greater than 50 μm. On the other hand, when the thickness of the elastic layer 61*c* is greater than 500 μm, the thermal resistance of the elastic layer 61*c* is high, and the quick start performance of the fixing apparatus 60 is degraded. Accordingly, the thickness of the elastic layer 61*c* may be set to be equal to or less than 500 μm, or may be equal to or less than 300 μm.

Further, when the rubber hardness of the elastic layer 61*c* is too high, the layer cannot follow the irregularity of the sheet P or toner image and glossiness unevenness easily occurs in a fixed image. Accordingly, the rubber hardness of the elastic layer 61*c* may be set to be equal to or less than 50° (JIS-A: JIS-K A type test machine) or may be equal to or less than 35°.

Further, as a thermal conductivity λ of the elastic layer 61*c*, $\lambda=6\times10^{-4}$ to $2\times10^{-3}$[cal/cm·sec·deg] is appropriate. When the thermal conductivity λ is less than $6\times10^{-4}$[cal/cm·sec·deg], the thermal resistance is high, and the temperature-rising in the surface layer of the fixing belt 61 (surface release layer 61*d*) is slow. On the other hand, when the thermal conductivity λ is greater than $2\times10^{-3}$[cal/cm·sec·deg], the hardness is excessively high or compressed permanent distortion becomes worse. Accordingly, the thermal conductivity λ of the elastic layer 61*c* may be set to $\lambda=6\times10^{-4}$ to $2\times10^{-3}$[cal/cm·sec·deg], or may be $8\times10^{-4}$ to $1.5\times10^{-3}$[cal/cm·sec·deg].

Further, as the surface release layer 61*d* becomes into direct contact with the unfixed toner image transferred on the sheet P, it is necessary to use material having excellent release characteristic and excellent thermal resistance. Accordingly, the material of the surface release layer 61*d* may be tetrafluoroethylene perfluoro alkylvinyl ether polymer (PFA), polytetrafluoroethylene (PTFE), fluorine resin, silicone resin, fluorosilicone rubber, fluorine rubber, silicone rubber or the like.

Further, the thickness of the surface release layer 61*d* may be 5 to 50 μm. When the thickness of the surface release layer 61*d* is less than 5 μm, coating unevenness occurs upon film coating and a low release characteristic area is formed, or durability is insufficient. Further, when the thickness of the surface release layer 61*d* is greater than 50 μm, the thermal conductivity is degraded. Especially in the case of the surface release layer 61*d* formed with a resin material, the hardness is too high and the function of the elastic layer 61*c* is degraded. Note that in this exemplary embodiment, PFA having a thickness of 30 μm is employed.

To improve the toner release characteristic in the surface release layer 61*d*, it may be arranged such that an oil coating mechanism to coat the surface release layer 61*d* with oil (lubricant) for prevention of toner offset is provided in contact with the fixing belt 61. Particularly, when toner not containing low softening material is used, the use of the oil coating mechanism is effective.

Figure 3B:
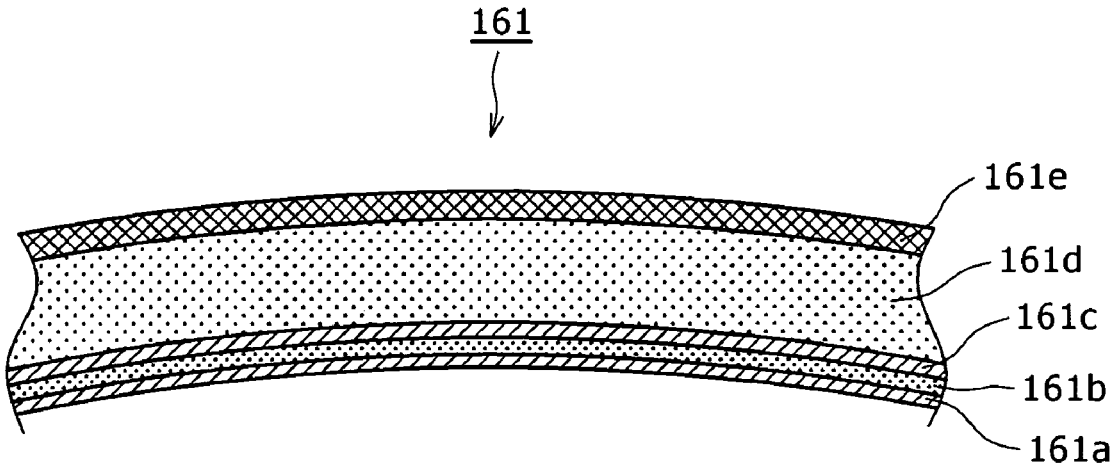

Note that the fixing belt 61 may be replaced with a fixing belt 161 as shown in FIG. 3B. In the fixing belt 161, thermal resistant resin layers 161*a* and 161*c* are separately formed, a conductive layer 161*b* is formed therebetween, and an elastic layer 161*d* and a surface release layer 161*e* are deposited on the surface. In the fixing belt 161, even if the metal layer as the conductive layer 161*b* is thin, degradation due to repetitive reception of bending deformation can be suppressed. Note that the thermal resistant resin layers 161*a* and 161*c* are not limited to thermal resistant resin.

Next, as shown in FIG. 2, the pressure roller 62 has a metal cylindrical member 62*a* as a core, an elastic layer 62*b* of silicone rubber, foam silicone rubber, fluorine rubber or fluorine resin having thermal resistance formed on the surface of the cylindrical member 62*a*, and an outermost surface release layer 62*c*. The pressure roller 62 is provided in parallel with the rotation axis of the fixing belt 61, and supported with its both ends biased by spring members (not shown) to the fixing belt 61 side. In this exemplary embodiment, the pressure roller 62 is biased to the pressing pad 63 with 294 N (30 kgf) via the fixing belt 61. The pressure roller 62 is rotate-driven in an arrow C direction, thereby rotates the fixing belt 61.

The pressing pad 63 is formed with an elastic material such as silicone rubber or fluorine rubber, thermal-resistant resin or the like such as polyimide resin, polyphenylene sulfide (PPS), polyether sulfone (PES) or liquid crystal polymer (LCP). The pressing pad 63 is provided in a widthwise direction of the fixing belt 61 in an area wider than an area through which the sheet P is passed (paper passing area), such that the pressure roller 62 is pressed along approximately the entire length of the pressing pad 63.

Further, the pressing pad 63 has a contact surface with respect to the fixing belt 61 as an concave surface along the outer surface shape of the pressure roller 62. In this arrangement, a sufficiently wide nip width can be acquired between the pressing pad and the pressure roller 62 via the fixing belt 61.

Further, to improve slidability between the pressing pad 63 and the fixing belt 61 in a fixing nip part N, a slide sheet 63*a* with excellent slidability and high abrasion resistance, formed with a polyimide film or a fluorine resin-impregnated glass fiber sheet is provided between the pressing pad 63 and the fixing belt 61. Further, the inner peripheral surface of the fixing belt 61 is coated with lubricant. As the lubricant, amino denatured silicone oil, dimethylsilicone oil or the like is used. These materials reduce the friction resistance between the fixing belt 61 and the pressing pad 63, thus enable smooth rotation of the fixing belt 61.

The pad support member 64 is a bar-shaped member having an axis line in the widthwise direction of the fixing belt 61. The pressing pad 63 is attached to a portion of the pad support member 64 facing the pressure roller 62, such that the pressing force applied from the pressure roller 62 via the fixing belt 61 to the pressing pad 63 is absorbed by the pad support member 64. For this purpose, the material of the pad support member 64 has a rigidity such that the amount of deflection upon reception of the pressing force from the pressure roller 62 is equal to or lower than a predetermined level, or may be equal to or less than 1 mm. Accordingly, considering the necessity of thermal resistance to the influence of magnetic flux by the electromagnetic induction heating unit 65 to be described later, thermal-resistant resin such as glass fiber-contained PPS, phenol, polyimide and liquid crystal polymer, thermal-resistant glass, or metal having a low specific resistance, which is not easily influenced by the induction heating, such as aluminum, is employed. In this exemplary embodiment, the pad support member 64 is formed with an aluminum member having a rectangular cross section with its longer axis in the direction of the pressing force from the pressure roller 62.

Further, in the pad support member 64, a ferrite member 67 of a material with high magnetic inductivity (e.g., ferrite or permalloy) to enhance the heating efficiency by the electromagnetic induction heating unit 65, and a thermistor 70 as a temperature detection unit to detect the temperature of the fixing belt 61, are fixed in press-contact with the inner peripheral surface of the fixing belt 61 via a spring member 71. In this case, the thermistor 70 is provided in the central portion of the lengthwise direction of the fixing belt 61, and another thermistor (not shown) is provided at one end of the fixing belt 61. Further, the pad support member 64 is provided with a thermo switch (not shown) so as to be in contact with or close to the fixing belt 61. Note that as the temperature detection unit, it may be arranged such that yet another thermistor to detect the temperature of the surface of the pressure roller 62 is provided in place of or in addition to the thermistor 70 to detect the temperature of the fixing belt 61.

Figure 4:
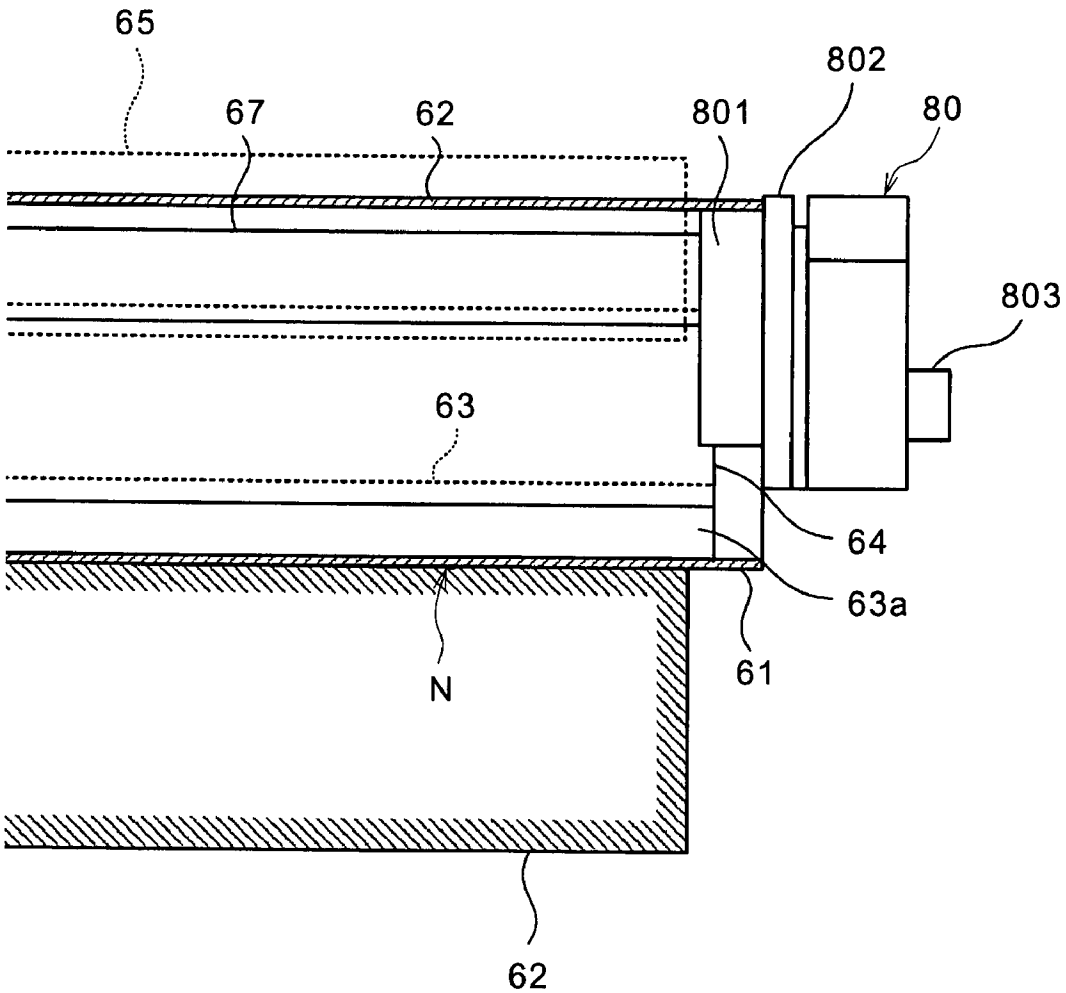
FIG. 4 is an enlarged side view showing the fixing belt supported with an edge guide member.

Further, edge guide members 80 (see FIG. 4) to support the fixing belt 61 are fixed at both ends of the pad support member 64 in its axial direction. The fixing belt 61, with its inner peripheral surface at the both ends supported with the edge guide members 80, rotates while maintaining a predetermined shape (e.g., approximate circular shape). FIG. 4 is an enlarged side view showing the fixing belt 61 supported with the edge guide member 80. FIG. 4 shows an area around one end of the fixing apparatus 60 viewed from the upstream side in the sheet P conveyance direction.

As shown in FIG. 4, the edge guide member 80 has a belt running guide 801 having a cylindrical shape with a notch in a portion corresponding to the fixing nip part N and its peripheral portion, i.e., having a C-shaped cross section, a flange 802 provided outside the belt running guide 801, having an outer diameter larger than that of the fixing belt 61, and a holder 803 provided in an outer side surface of the edge guide member 80, to couple the edge guide member 80 with the fixing apparatus 60 main body.

The fixing belt 61 rotates, while being supported with the belt running guides 801 of the edge guide members 80 in both end inner peripheral surfaces in the widthwise direction of the fixing belt 61, in accordance with the pressure roller 62. Further, the movement (belt walk) of the fixing belt 61 in its widthwise direction is limited with the flanges 802, thereby eccentricity of the fixing belt 61 is suppressed.

Next, the electromagnetic induction heating unit 65 will be described. As shown in FIG. 2, the electromagnetic induction heating unit 65 includes a pedestal 65*a* having a curved surface along the outer peripheral surface shape of the fixing belt 61 along the widthwise direction of the fixing belt 61 on the fixing belt 61 side, exciting coils 65*b* supported with the pedestal 65*a*, and an exciting circuit 65*c* as an example of a power supply unit to supply a high frequency current to the exciting coils 65*b*.

The pedestal 65*a* is formed with an insulating and thermal resistant material such as phenol resin, polyimide resin, polyamide resin, polyamide imide resin or liquid crystal polymer resin. Further, as the exciting coil 65*b*, a Litz wire, including plural cupper lines $\phi$0.1 to 0.5 mm in diameter mutually insulated with a thermal-resistant insulating material (e.g., polyimide resin or polyamide imide resin), is coiled plural times (e.g., 11 turns) in closed loop shape such as oval shape, elliptic shape or rectangular shape. The exciting coil 65*b* is bound with adhesive, thereby fixed, with its shape maintained, to the pedestal 65*a*.

Further, the distance between the exciting coil 65*b* and the ferrite member 67, and the conductive layer 61*b* of the fixing belt 61 is within 5 mm, e.g., about 2.5 mm, since these members may be provided as close as possible to each other so as to enhance magnetic flux absorption efficiency.

In the electromagnetic induction heating unit 65, when a high frequency current is supplied from the exciting circuit 65*c* to the exciting coil 65*b*, a magnetic flux repetitively appears and disappears around the exciting coil 65*b*. The frequency of the high frequency current is set to e.g. 10 to 500 kHz. In the present invention, the frequency is set to 20 to 100 kHz. When the magnetic flux from the exciting coil 65*b* passes across the conductive layer 61*b* of the fixing belt 61, a magnetic field to prevent change of the magnetic field occurs in the conductive layer 61*b* of the fixing belt 61, thereby an eddy current occurs in the conductive layer 61*b*. In the conductive layer 61*b*, Joule heat ($W=I^2R$) in proportional to skin resistance (R) of the conductive layer 61*b* is caused with the eddy current (I), thereby the fixing belt 61 is heated.

Note that at this time, a predetermined temperature of the fixing belt 61 is maintained by controlling the amount of electric power or supply time of a high frequency current supplied to the exciting coil 65*b* by the controller 40 (see FIG. 1) of the image forming apparatus based on a measurement value by the thermistor 70 as an example of a temperature detection unit.

In the image forming apparatus according to this exemplary embodiment, approximately at the same time of the start of toner image forming operation, electric power is supplied to a drive motor (not shown) to drive the pressure roller 62 and the electromagnetic induction heating unit 65 in the fixing apparatus 60, and the fixing apparatus 60 is started. Then the fixing belt 61 is rotated in accordance with the pressure roller 62. In addition, when the fixing belt 61 passes through a heating area facing the electromagnetic induction heating unit 65, an eddy current is induced to the conductive layer 61*b* of the fixing belt 61, and the fixing belt 61 generates heat. Thereafter, in a state where the fixing belt 61 has been evenly heated to a predetermined temperature, the sheet P holding an unfixed toner image is fed to the fixing nip part N where the fixing belt 61 and the pressure roller 62 are in press-contact. In the fixing nip part N in the paper passing area, the sheet P and the toner image held on the sheet P are heated and pressed, thereby the toner image is fixed onto the sheet P. Thereafter, the sheet P is separated from the fixing belt 61 by the change of curvature of the fixing belt 61, and conveyed to the discharge paper tray provided at the discharge port of the image forming apparatus. At this time, as an auxiliary unit to completely separate the sheet P from the fixing belt 61, a separation auxiliary member 75 may be provided on the downstream side of the fixing nip part N of the fixing belt 61.

In the fixing apparatus 60 according to this exemplary embodiment, as the fixing belt 61 is evenly heated to the predetermined temperature necessary for fixing a toner image, an excellent toner image where the occurrence of glossiness unevenness, offset or the like is suppressed can be formed. Further, as the fixing belt 61 has an extremely small thermal capacity, the fixing belt 61 can be heated at a high speed. Accordingly, the warm-up time can be extremely short. Further, as fixing apparatus has an excellent on-demand characteristic, the electric consumption in stand-by time can be greatly reduced.

Further, as a sufficiently wide nip width can be acquired with the pressing pad 63 with respect to the pressure roller 62 via the fixing belt 61, thermal conduction in the fixing nip part N can be sufficiently performed, and excellent fixing performance can be acquired.

Next, control of electric power supplied to the exciting coil 65*b* to heat the fixing belt 61 will be described.

Figure 5:
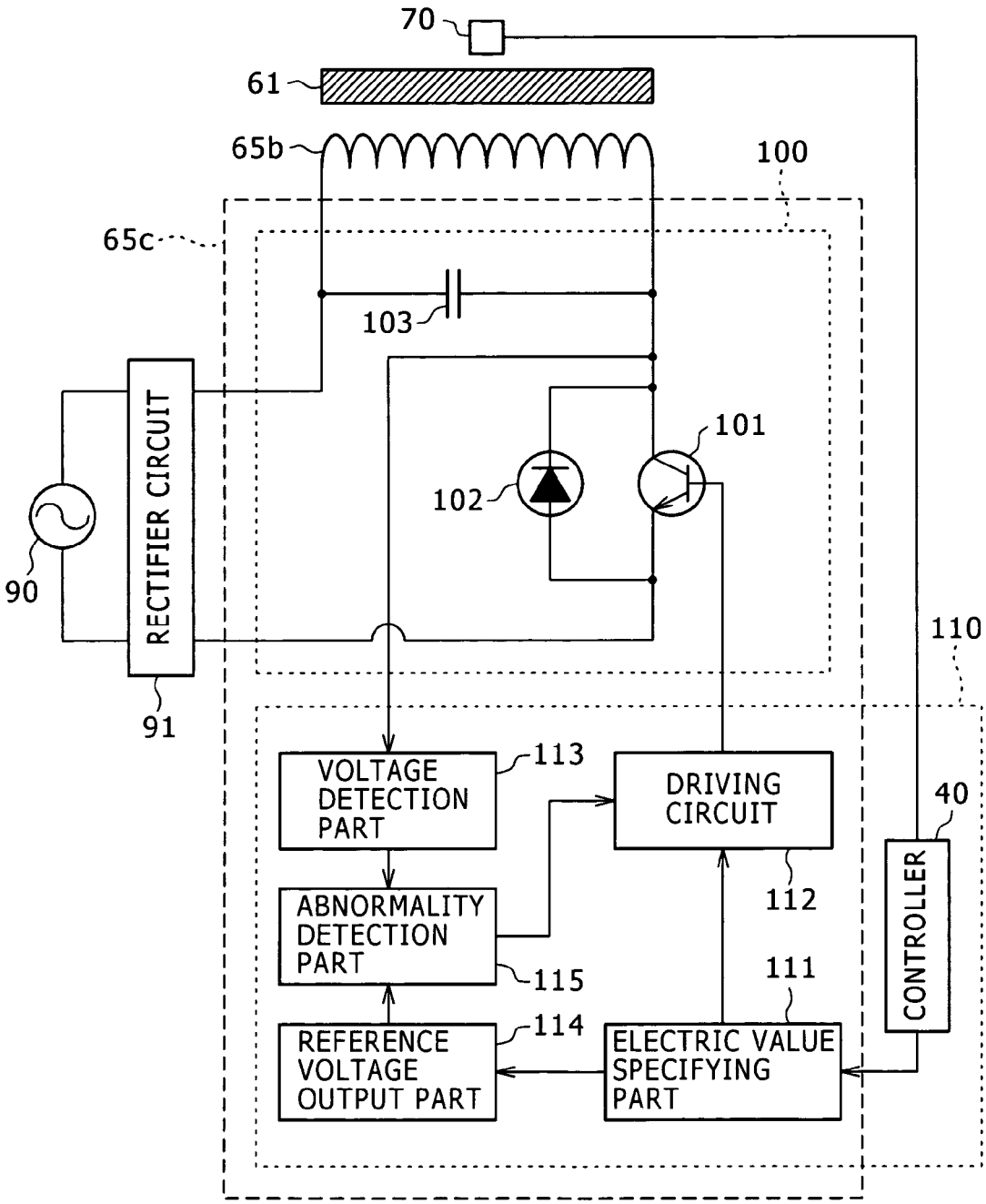
FIG. 5 is a block diagram showing the configuration of an exciting circuit to supply electric power to an exciting coil.

FIG. 5 is a block diagram showing the configuration of the exciting circuit 65*c* to supply electric power to the exciting circuit 65*b*. In this exemplary embodiment, the exciting circuit 65*c* is a so-called inverter circuit which generates a high frequency wave by ON/OFF control of a direct current.

A direct current (DC) acquired by rectifying an alternating current from a commercial power source 90 (AC 100 V) by a rectifier circuit 91 is inputted into the exciting circuit 65*c*. The exciting circuit 65*c* has an inverter 100 to generate a high frequency wave by using the direct current inputted from the rectifier circuit 91 and a drive controller 110 to control a high frequency wave generating operation in the inverter 100 in addition to control by the controller 40 provided in the image forming apparatus main body.

Among these elements, the inverter 100 has a switching element 101 to generate a high frequency current by ON/OFF controlling the direct current inputted from the rectifier circuit 91, a diode 102 connected in parallel with the switching element 101, and a resonance capacitor 103 connected in parallel with the exciting coil 65*b*. The switching element 101 is formed with an npn type transistor, and the exciting coil 65*b* and the resonance capacitor 103 are connected to the collector side of the transistor. Note that the resonance capacitor 103 forms, with the exciting coil 65*b*, an LC resonance circuit.

On the other hand, the drive controller 110 has the controller 40, an electric value specifying part 111, a driving circuit 112, a voltage detection part 113, a reference voltage output part 114, and an abnormality detection part 115. The controller 40 ON/OFF controls electric power supply to the exciting coil 65*b* based on the temperature of the fixing belt 61 detected by the thermistor 70. Further, the electric value specifying part 111 as an example of a specifying unit sets an electric power value to be supplied to the exciting coil 65*b* as a specified electric value based on the detected temperature sent from the controller 40. Further, the driving circuit 112 as an example of an output unit controls the ON duty width (a period where the switching element 101 is turned ON) based on a signal corresponding to the specified electric value outputted from the electric value specifying part 111, and outputs a driving signal (pulse signal) to the switching element 101. Further, the voltage detection part 113 as an example of a voltage detection unit detects a flyback voltage generated in the resonance circuit including the exciting coil 65*b* (constituted with the exciting coil 65*b* and the resonance capacitor 103). Note that the voltage detection part 113 actually detects a voltage applied between the emitter and the collector of the switching element 101 (between the anode and the cathode of the diode 102). Further, the reference voltage output part 114 as an example of a reference value output unit outputs a reference voltage value (flyback voltage reference value) corresponding to the specified electric value outputted from the electric value specifying part 111. The abnormality detection part 115 as an example of an abnormality detection unit calculates a change ratio between the actual measurement value of the voltage outputted from the voltage detection part 113 (flyback voltage value) and the reference voltage value outputted from the reference voltage output part 114, and detects overheating of the fixing belt 61 as a heated body.

Further, when heating is quickly performed upon electric power supply to the exciting coil 65*b*, the electric value specifying part 111 reduces the specified value of electric power to be supplied (specified electric value) based on the temperature of the fixing belt 61 detected by the thermistor 70. When the amount of heat absorbed by the sheet P or the like is large and the detected temperature tends to be lowered, the electric value specifying part 111 sets the specified electric value to a higher value. Further, upon preparatory heating of the fixing belt 61 and upon fixing operation, different electric values are set.

Further, the reference voltage output part 114 outputs a reference voltage value, i.e., a voltage value as a reference for determining whether the temperature of the fixing belt 61 as a heated body is normal or abnormal. The reference voltage output part 114 outputs, or calculates and outputs a value corresponding to the specified electric value. When the specified electric value is large, the ON duty width of the driving signal outputted from the driving circuit 112 is large, and the flyback voltage is increased. Accordingly, to detect increase of the flyback voltage value due to abnormal temperature rise, it is necessary to set the reference voltage value in correspondence with the specified electric value.

Further, considering that the specified electric value (the amount of electric power to be supplied), the temperature of the exciting coil 65*b*, the speed of temperature change and the like when the fixing belt 61 as a heated body is quickly heated are different from those when the fixing belt 61 is heated so as to maintain a predetermined fixing belt temperature, different settings are adopted in calculation of the reference voltage value upon preparatory heating and driving of the fixing apparatus.

Note that the reference voltage value in this exemplary embodiment means a reference value of a flyback voltage generated upon electric power supply to the inverter 100 based on some specified electric value in a normal state.

Further, the abnormality detection part 115 calculates the difference (change ratio) between the flyback voltage value detected by the voltage detection part 113 and the reference voltage value outputted from the reference voltage output part 114. When the acquired change ratio has exceeded a predetermined value, the abnormality detection part 115 determines that the temperature of the fixing belt 61 and that of the exciting coil 65*b* are abnormally high and the impedance is extremely high.

Figure 6:
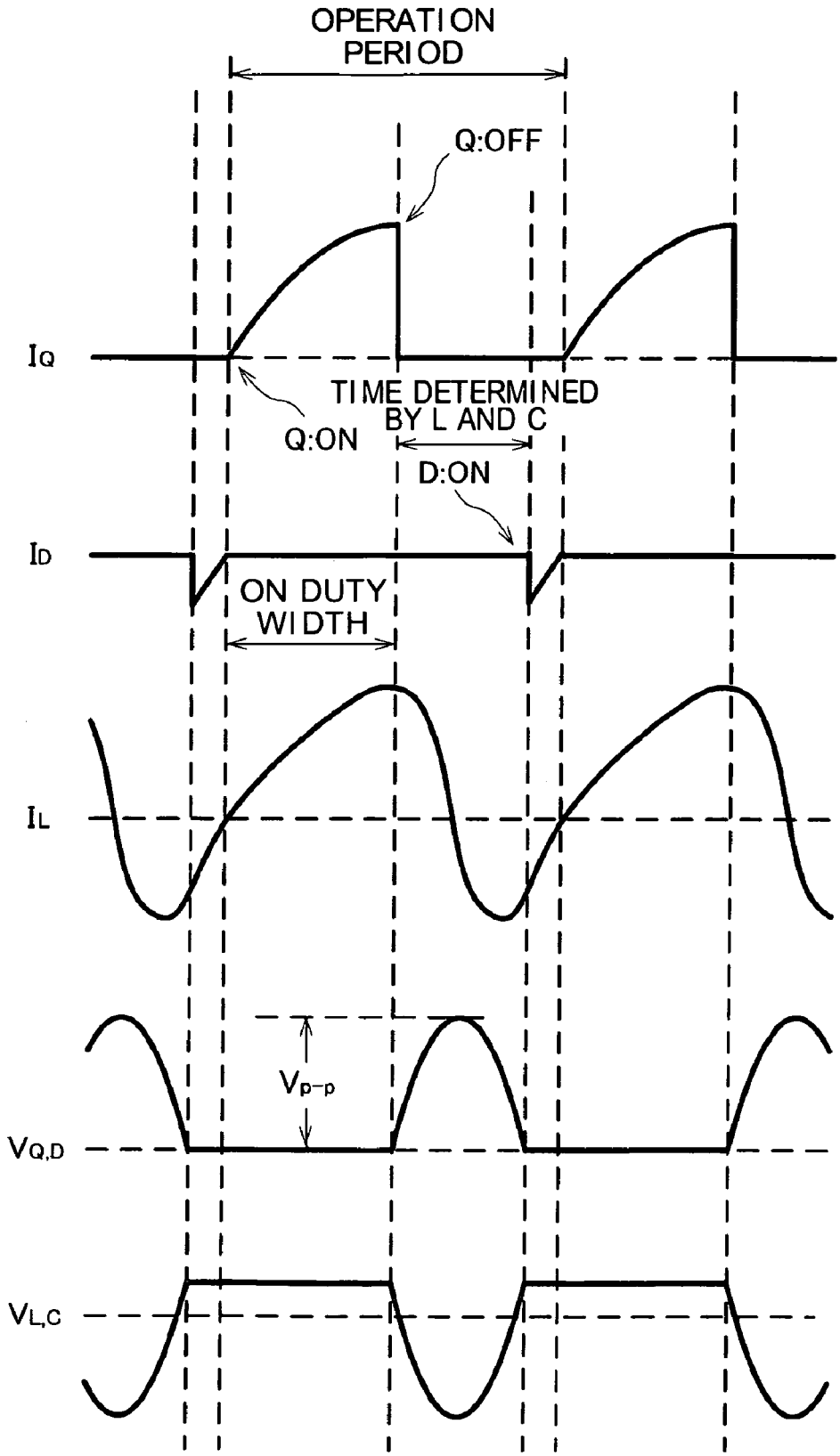
FIG. 6 is a timing chart showing changes of current and voltage in the parts of the exciting circuit.

Next, the ON/OFF control of the switching element 101 and the changes of current value and voltage value in the elements of the inverter 100 in accordance with the ON/OFF control will be described with reference to the timing chart shown in FIG. 6. Note that in FIG. 6, the top part indicates a switching current $I_Q$ flowing through the switching element 101; the next part indicates a diode current $I_D$ flowing through the diode 102; the next part indicates a coil current $I_L$ flowing through the exciting coil 65*b*; the next part indicates a flyback voltage $V_{Q,D}$ generated between the emitter and the collector of the switching element 101 (between the anode and the cathode of the diode 102); and the lowest part indicates an LC voltage $V_{L,C}$ generated at both ends of the LC resonance circuit constituted with the exciting coil 65*b* and the resonance capacitor 103.

When the switching element 101 is turned ON (Q: ON), a current flows through the exciting coil 65*b*, and the amount of coil current $I_L$ is gradually increased by the inductive component of the exciting coil 65*b*. Thereafter, when the switching element 101 is turned OFF (Q: OFF), the amount of the coil current $I_L$ flowing through the exciting coil 65*b* is gradually reduced while the resonance capacitor 103 is charged. In accordance with the charging of the capacitor 103, the value of the flyback voltage $V_{Q,D}$ is increased, then reduced. Note that the maximum value of the flyback voltage $V_{Q,D}$ is called a peak-to-peak voltage value Vp-p. Further, the coil current $I_L$ flowing through the exciting coil 65*b* turns in the opposite direction, and a regenerative current with a very short period is generated in the diode 102 inserted in parallel with the switching element 101 (D: ON). Then, the switching element 101 is turned ON again. In this switching, the timing of tuning OFF to the timing of turning ON is determined by the exciting coil 65*b* and the resonance capacitor 103 forming the LC resonance circuit (time determined by L and C), and the period where the switching element is turned ON, i.e., the ON duty width is determined by setting one period (operating period) of switching. When the ON duty width is increased, the amount of supplied electric power is increased. Accordingly, the one period of switching or ON duty width is set based on the value of electric power supplied to the exciting coil 65*b* (specified electric value) outputted from the drive controller 110.

In the fixing belt 61, it is necessary to maintain an appropriate temperature for fixing a toner image onto the sheet P. Control of the temperature and control for prevention of overheating in an abnormal state are performed as follows based on the output from the thermistor 70 or the like.

In the fixing apparatus 60, when the power switch (not shown) is turned ON, initial heating (warming up) is performed. More particularly, the controller 40 outputs an ON signal, thereby the electric value specifying part 111 outputs a specified electric value to the driving circuit 112. The driving circuit 112 outputs a driving signal with the ON duty width set based on the received specified electric value, and the switching element 101 of the inverter 100 is turned ON/OFF based on the driving signal. Then a high frequency current is generated in the inverter 100. The exciting coil 65*b* generates a varying magnetic field with the generated high frequency current, and as a result, an eddy current is generated in the conductive layer 61*b* of the fixing belt 61, and heat is generated. At this time, the temperature of the fixing belt 61 is detected by the thermistor 70. Then the temperature becomes a predetermined temperature, and the preparation of fixing operation is completed.

Thereafter, the apparatus setting is changed to a setting upon normal driving for fixing an unfixed toner image on the sheet P. Next, when the sheet P holding an unfixed toner image is sent, the sheet P is pressed between the fixing belt 61 and the pressure roller 62, then the unfixed toner image on the sheet P is press-heated and fixed. In these processes, the temperature of the fixing belt 61 is detected by the thermistor 70, and based on the result of temperature detection, the electric value specifying part 111 outputs a specified electric value. That is, when the detected temperature is high, it is determined that the supplied electric power is excessive, and the electric value specifying part 111 changes the specified electric value to a smaller value. When the temperature of the fixing belt 61 is low, it is determined that the supplied electric power is insufficient, and the electric value specifying part 111 changes the specified electric value to a greater value.

Further, when the supplied electric power is excessive (the temperature detected by the thermistor 70 is high) even though the specified electric value is set to a smaller value, the controller 40 outputs a signal to turn the supply of a high frequency current OFF to the electric value specifying part 111. In accordance with the signal, the driving signal from the driving circuit 112 is temporarily stopped. As the switching element 101 is turned OFF, the temperature of the fixing belt 61 is lowered in accordance with heat transfer from the fixing belt 61 to the sheet P and the toner image as well as heat radiation. Thereafter, when the temperature detected by the thermistor 70 is lower than a predetermined control lower limit value, the controller 40 outputs a signal to turn the supply of high frequency current ON, i.e., a signal instructing the electric value specifying part 111 to output the specified electric value, and instructing the driving circuit 112 to output the driving signal. Then, the driving circuit 112 outputs the driving signal, the high frequency current is supplied to the exciting coil 65*b* again, and the fixing belt 61 is heated. Then the temperature of the fixing belt 61 rises, and when the result of temperature detection by the thermistor 70 becomes a control upper limit value, the signal from the drive controller 110 turns OFF, and the driving signal from the driving circuit 112 is stopped. Accordingly, the temperature of the fixing belt 61 is controlled between the predetermined control upper limit and control lower limit.

The abnormality detection part 115 is controlled as described above. When the driving signal is outputted from the driving circuit 112, the abnormality detection part 115 prevents overheating of the fixing belt 61 as follows.

The fixing belt 61 having the conductive layer 61*b* has a characteristic that its specific resistance value rises in accordance with temperature rise by electromagnetic induction heating. Assuming that the exciting coil 65*b* is the first side while the fixing belt 61 is the second side, the resistive component of the exciting coil 65*b* is R1, the inductive component of the exciting coil 65*b* is L1, the resistive component of the fixing belt 61 is R2, the inductive component of the fixing belt 61 is L2, and a coupling factor between the both components is A, a load impedance Z of the exciting coil 65*b* is $$Z=(R1+A\times R2)+j\omega(L1-A\times L2)$$

$$A\approx M/L2 (M \text{ is mutual inductance})$$

Note that actually, the resistive component of the load impedance Z is reduced while the inductive component is increased in accordance with the temperature rise of the fixing belt 61. It is understood that this phenomenon is caused by the reduction of the coupling factor A, i.e., the reduction of magnetic coupling between the exciting coil 65*b* and the fixing belt 61.

The reduction of the coupling factor A between the exciting coil 65*b* and the fixing belt 61 means that the physical distance between the exciting coil 65*b* and the fixing belt 61 has been increased, i.e., the fixing belt 61 has moved away from the exciting coil 65*b*. For example, when the fixing belt 61 is overheated, the fixing belt 61 shrinks and its perimeter becomes shorter. That is, as it is apparent from FIG. 2, when the fixing belt 61 shrinks by overheating, it moves away from the exciting coil 65*b*.

Further, when the magnetic coupling is reduced in accordance with the temperature rise of the fixing belt 61, the frequency of the high frequency current supplied from the inverter 100 is lowered. When the frequency of the high frequency current is lowered, the operation period is prolonged, and the period where the switching element 101 is ON and the period where the switching element 101 is OFF are prolonged. As a result, the peak-to-peak voltage value Vp-p as the maximum value of the flyback voltage $V_{Q,D}$ in the OFF period rises.

Accordingly, in this exemplary embodiment, the voltage detection part 113 of the drive controller 110 monitors the flyback voltage flyback voltage $V_{Q,D}$, and the abnormality detection part 115 detects the occurrence of abnormality in the fixing belt 61. That is, in this exemplary embodiment, the reduction of magnetic coupling between the exciting coil 65*b* and the conductive layer 61*b* of the fixing belt 61 is detected via the flyback voltage $V_{Q,D}$ measured by the voltage detection part 113 as a detection unit.

Figure 7:
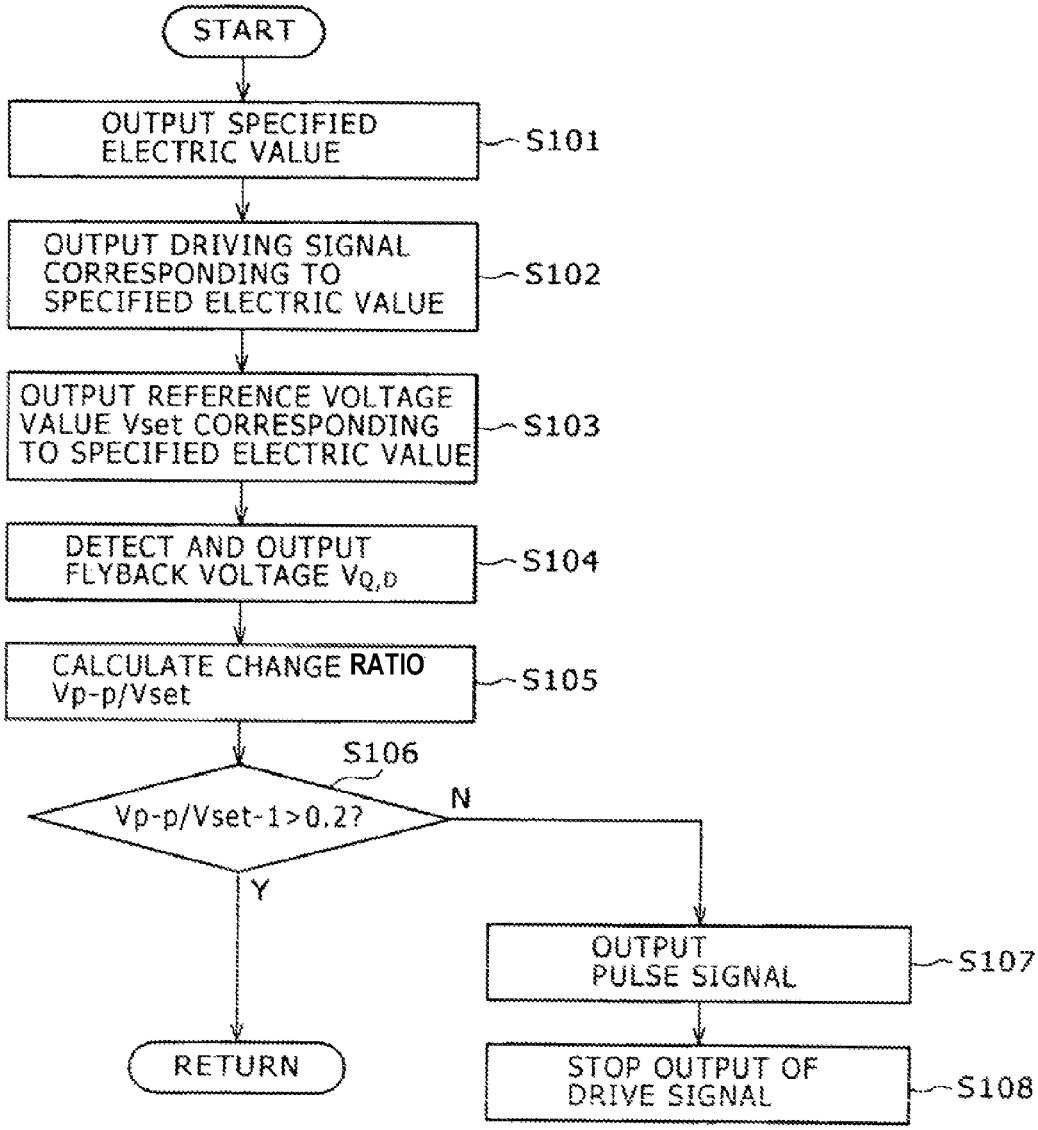
FIG. 7 is a flowchart showing a processing procedure upon detection of abnormal heating of the fixing belt.

Next, a process procedure of detection of abnormal heating of the fixing belt 61 in the fixing apparatus 60 according to this exemplary embodiment will be described. FIG. 7 is a flowchart showing a processing procedure upon detection of abnormal heating of the fixing belt 61.

When a predetermined specified electric value is outputted from the electric value specifying part 111 (step S101), the driving circuit 112 outputs a driving signal corresponding to the received specified electric value to the switching element 101 (step S102). On the other hand, the reference voltage output part 114 outputs a reference voltage value Vset corresponding to the received specified electric value to the abnormality detection part 115 (step S103). Further, the voltage detection part 113 detects the flyback voltage $V_{Q,D}$ generated in accordance with the ON/OFF operation of the switching element 101 and outputs it to the abnormality detection part 115 (step S104). Then the abnormality detection part 115 calculates Vp-p/Vset as the change ratio between the reference voltage value Vset inputted from the reference voltage output part 114 and the peak-to-peak voltage value Vp-p as the maximum value of the flyback voltage $V_{Q,D}$ inputted from the voltage detection part 113 (step S105). Then, the abnormality detection part 115 determines using the acquired change ratio Vp-p/Vset whether or not Vp-p/Vset-1 is greater than 0.2, i.e., the level of the peak-to-peak voltage value Vp-p as the maximum value of the flyback voltage $V_{Q,D}$ is over 20% of its normal state (step S106). If the result of determination at step S106 is NO, it is determined that the fixing belt 61 has no problem, and the process ends. On the other hand, if the result of determination at step S106 is YES, it is determined that the fixing belt 61 is overheated and its temperature is abnormally high, and the abnormality detection part 115 having a function as an example of a stoppage unit outputs a pulse signal to the driving circuit 112 (step S107). The driving circuit 112 receives the pulse signal from the abnormality detection part 115, and stops the output of the driving signal to the switching element 101 (step S108). By this operation, the electromagnetic induction heating of the fixing belt 61 using the exciting coil 65*b* is stopped.

Next, the reason of the determination based on whether or not Vp-p/Vset-1 is over 0.2 performed at step S106 of the above-described processing will be described.

Figure 8A:
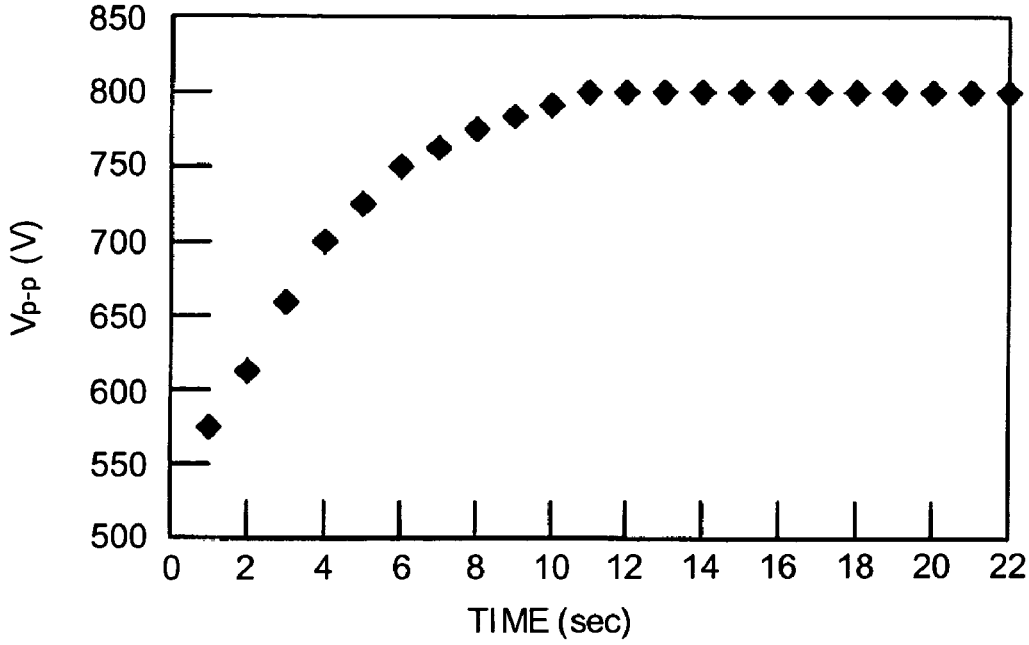
FIG. 8A is a graph showing the relation between elapsed time from the start of electromagnetic induction heating and peak-to-peak voltage value of a flyback voltage generated by the electromagnetic induction heating while rotation of the fixing belt is stopped.
Figure 8B:
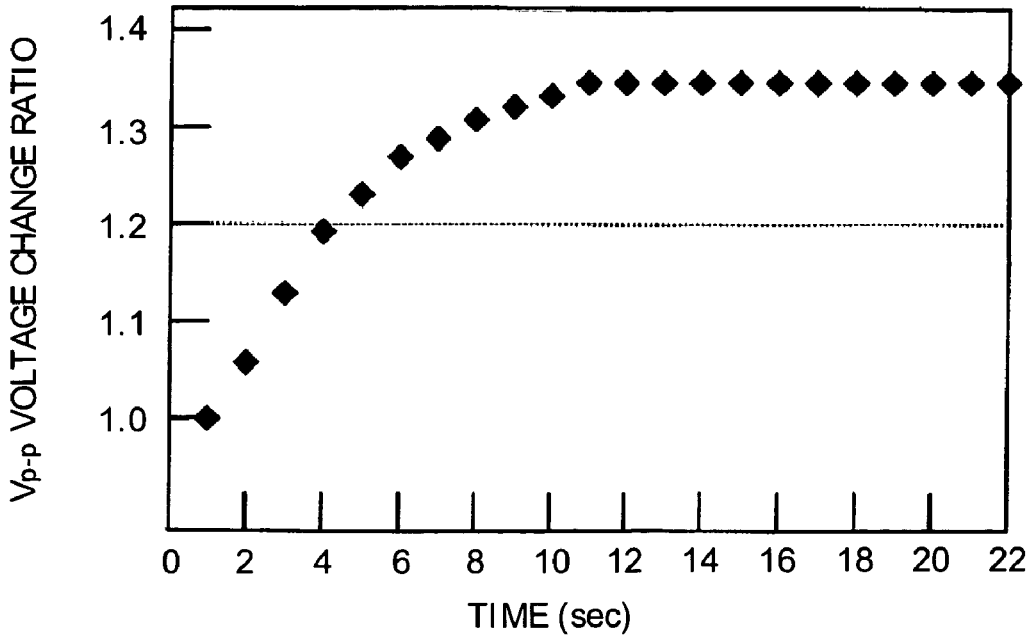
FIG. 8B is a graph acquired by normalizing the graph of FIG. 8A with an initial-state peak-to-peak voltage value.
Figure 9:
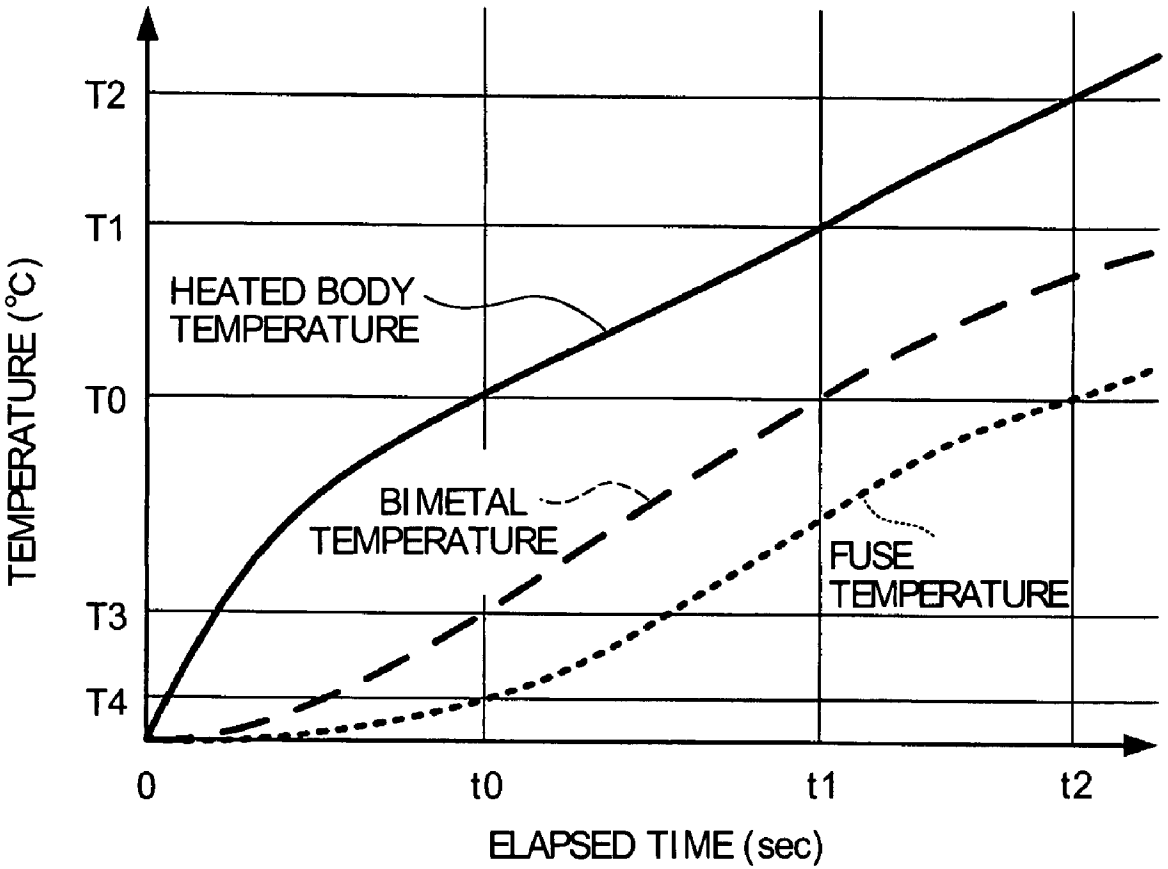
FIG. 9 RELATED ART
FIG. 9 is a graph schematically and time sequentially showing changes of temperatures of a heated body, and a bimetal and a temperature fuse provided in the vicinity of the heated body.

FIG. 8A is a graph showing the relation between elapsed time from the start of electromagnetic induction heating and the peak-to-peak voltage value Vp-p of the flyback voltage $V_{Q,D}$ generated by the electromagnetic induction heating with the exciting coil 65*b* when rotation of the fixing belt 61 is stopped in the above-described fixing apparatus 60. FIG. 8B is a graph acquired by normalizing the graph of FIG. 8A with the peak-to-peak voltage value Vp-p of the flyback voltage $V_{Q,D}$ generated in the initial state (Vp-p voltage change ratio).

It is understood from FIG. 8A that when the electromagnetic induction heating is performed while the fixing belt 61 is stopped, the peak-to-peak voltage value Vp-p of the flyback voltage $V_{Q,D}$ rapidly rises. This means that in accordance with rapid rise of the temperature of the fixing belt 61 by the electromagnetic induction heating, the fixing belt 61 heat-shrinks, and as a result, the fixing belt 61 moves away from the exciting coil 65*b*, and the magnetic coupling between the fixing belt 61 and the exciting coil 65*b* is reduced. However, it is understood from FIG. 8A that about 10 seconds from the start of electromagnetic induction heating, the peak-to-peak voltage value Vp-p becomes approximately constant, i.e., the fixing belt 61 does not shrink any longer.

Referring to FIG. 8B, it is understood that the level of the peak-to-peak voltage value Vp-p is increased from the initial state by 20% about four seconds from the start. In the normal fixing operation, the distance between the exciting coil 65*b* and the fixing belt 61 slightly changes due to vibration or the like caused by the operation, however, the change is not so big as the above change. Accordingly, when the change ratio exceeds 20%, it is determined that heat shrinkage occurs in the fixing belt 61 by overheating.

Accordingly, in this exemplary embodiment, at the above-described step S106, it is determined based on the above reference whether or not an abnormality due to overheating has occurred in the fixing belt 61.

As described above, in this exemplary embodiment, as the deformation (shrinkage) of the fixing belt 61 by overheating is detected based on the level of the flyback voltage generated on the exciting circuit 65*c* side, an abnormality can be quickly detected when the fixing belt 61 is overheated. Further, as the power supply to the exciting coil 65*b* is stopped immediately after the detection of the abnormality, the occurrence of further inconvenience can be prevented.

Further, in this exemplary embodiment, the flyback voltage reference voltage value corresponding to the specified electric value is previously acquired, and it is determined based on the difference between the reference value and the actually measured flyback voltage value whether or not an abnormality has occurred in the fixing belt 61. This enables more accurate detection of an abnormality that has occurred in the fixing belt 61.

In this exemplary embodiment, it can be considered that it is determined whether or not the fixing belt 61 is deformed by overheating by detecting the reduction of magnetic coupling between the fixing belt 61 and the exciting coil 65*b* via the flyback voltage generated on the exciting circuit 65*c* side.

Note that in this exemplary embodiment, the resonance capacitor 103 is connected in parallel with the exciting coil 65*b*, however, the connection is not limited to this form. For example, the LC resonance circuit can be constituted by serially connecting the both members.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A heating apparatus comprising:

an exciting coil provided in close vicinity of a heated body having a conductive layer;

a capacitor connected serially or in parallel with the exciting coil;

a switching element that generates a high frequency current by turning a direct current on and off, and that supplies the high frequency current to the exciting coil and the capacitor;

a specifying unit that specifies an electric value relating to high frequency current to be supplied to the exciting coil;

an output unit that outputs, to the switching element, a driving signal to turn on the switching element for a period determined in correspondence with the electric value specified by the specifying unit;

a voltage detection unit that detects a flyback voltage value generated in a resonance circuit including the exciting coil and the capacitor;

a reference value output unit that outputs a flyback voltage reference value; and an abnormality detection unit that calculates a voltage change ratio between the detected flyback voltage value and the flyback voltage reference value, and determines that an abnormality in the heated body exists when the voltage change ratio exceeds a predetermined value;

wherein the detected flyback voltage value and the flyback voltage reference value correspond to a same electric value specified by the specifying unit.

2. The heating apparatus according to claim 1, further comprising a stoppage unit that stops power supply to the exciting coil when an abnormality in the heated body has been detected by the abnormality detection unit.

3. The heating apparatus according to claim 1, further comprising a temperature detection unit that detects a temperature of the heated body, wherein the specifying unit specifies the electric value relating to high frequency current to be supplied to the exciting coil based on a result of temperature detection by the temperature detection unit.

4. A fixing apparatus for fixing an unfixed toner image on a recording material, comprising:

a belt member, formed with a multilayer structure including a conductive layer, that is rotatably provided;

an exciting coil that performs electromagnetic induction heating on the belt member;

a capacitor connected serially or in parallel with the exciting coil;

a switching element that generates a high frequency current by turning a direct current on and off, and that supplies the high frequency current to the exciting coil and the capacitor;

a specifying unit that specifies an electric value relating to high frequency current to be supplied to the exciting coil;

an output unit that outputs, to the switching element, a driving signal to turn on the switching element for a period determined in correspondence with the electric value specified by the specifying unit;

a voltage detection unit that detects a flyback voltage value generated in a resonance circuit including the exciting coil and the capacitor; and an abnormality detection unit that detects an abnormality in the belt member when a voltage change ratio between the detected flyback voltage value and a flyback voltage reference value exceeds a predetermined value, wherein the detected flyback voltage value and the flyback voltage reference value correspond to a same electric value specified by the specifying unit.

5. The fixing apparatus according to claim 4, wherein when the abnormality detection unit has detected an abnormality in the belt member, the abnormality detection unit outputs a signal to cause the output unit to stop output of the driving signal.

6. A fixing apparatus for fixing an unfixed toner image on a recording material, comprising:

a belt member, formed with a multilayer structure including a conductive layer, that is rotatably provided;

an exciting coil that performs electromagnetic induction heating on the belt member;

a capacitor connected serially or in parallel with the exciting coil;

a switching element that generates a high frequency current by turning a direct current on and off, and that supplies the high frequency current to the exiting coil and the capacitor;

a specifying unit that specifies an electric value relating to high frequency current to be supplied to the exciting coil;

a power supply unit that performs power supply on the exciting coil;

a voltage detection unit that detects a flyback voltage value generated in a resonance circuit including the exciting coil and the capacitor;

a determination unit that determines reduction of magnetic coupling between the conductive layer of the belt member and the exciting coil based on a voltage change ratio between the detected flyback voltage value and a flyback voltage reference value; and a stoppage unit that stops the power supply by the power supply unit when the reduction of magnetic coupling determined by the determination unit has exceeded a predetermined level;

wherein the detected flyback voltage value and the flyback voltage reference value correspond to a same electric value specified by the specifying unit.

7. A heating apparatus comprising:

an exciting coil provided in close vicinity of a heated body having a conductive layer;

a power supply unit that performs power supply on the exciting coil, the power supply unit including at least a capacitor connected serially or in parallel with the exciting coil and a switching element that generates a high frequency current by turning a direct current on and off, and that supplies the high frequency current to the exciting coil and the capacitor;

a specifying unit that specifies an electric value relating to high frequency current to be supplied to the exciting coil;

a voltage detection unit that detects a flyback voltage value generated in a resonance circuit including the exciting coil and the capacitor;

a determination unit that determines reduction of magnetic coupling between the conductive layer of the heated body and the exciting coil based on a voltage change ratio between the detected flyback voltage value and a flyback voltage reference value; and a stoppage unit that stops the power supply by the power supply unit when the detection unit detects that the reduction of magnetic coupling has exceeded a predetermined level;

wherein the detected flyback voltage value and the flyback voltage reference value correspond to a same electric value specified by the specifying unit.

8. The heating apparatus according to claim 7, wherein the determination unit determines the reduction of magnetic coupling when the following expression is satisfied:

$$(V_{p\text{-}p}/V_{set})-1>0.2$$

wherein $V_{p\text{-}p}$ and $V_{set}$ denote a peak-to-peak voltage of the flyback voltage and the flyback voltage reference value, respectively.

* * * * *